US010339862B2

(12) United States Patent
Yoon et al.

(10) Patent No.: US 10,339,862 B2
(45) Date of Patent: Jul. 2, 2019

(54) PIXEL AND ORGANIC LIGHT EMITTING DISPLAY DEVICE USING THE SAME

(71) Applicant: SAMSUNG DISPLAY CO., LTD., Yongin-si, Gyeonggi-do (KR)

(72) Inventors: Zi Yeon Yoon, Yongin-si (KR); In Soo Wang, Yongin-si (KR); Gi Chang Lee, Yongin-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 180 days.

(21) Appl. No.: 15/162,701

(22) Filed: May 24, 2016

(65) Prior Publication Data

US 2017/0047004 A1 Feb. 16, 2017

(30) Foreign Application Priority Data

Aug. 12, 2015 (KR) ..... 10-2015-0113903

(51) Int. Cl.
*G09G 3/3233* (2016.01)
*G09G 3/3275* (2016.01)
*G09G 3/3266* (2016.01)

(52) U.S. Cl.
CPC ..... *G09G 3/3233* (2013.01); *G09G 3/3266* (2013.01); *G09G 3/3275* (2013.01); *G09G 2300/0809* (2013.01); *G09G 2310/08* (2013.01); *G09G 2320/0233* (2013.01)

(58) Field of Classification Search
None
See application file for complete search history.

(56) References Cited

U.S. PATENT DOCUMENTS

| | | | | |
|---|---|---|---|---|
| 8,547,372 | B2 | 10/2013 | Chung et al. | |
| 2013/0201172 | A1 | 8/2013 | Jeong et al. | |
| 2014/0333600 | A1* | 11/2014 | Lee | H01L 27/3262 345/212 |
| 2015/0049126 | A1 | 2/2015 | Jung | |
| 2015/0054812 | A1 | 2/2015 | Jeon | |

FOREIGN PATENT DOCUMENTS

| | | | |
|---|---|---|---|
| KR | 10-1097325 | B1 | 12/2011 |
| KR | 10-2013-0091136 | A | 8/2013 |
| KR | 10-2015-0019592 | A | 2/2015 |
| KR | 10-2015-0022294 | A | 3/2015 |
| KR | 10-2015-0064543 | A | 6/2015 |

* cited by examiner

*Primary Examiner* — Amr A Awad
*Assistant Examiner* — Andre L Matthews
(74) *Attorney, Agent, or Firm* — Lee & Morse, P.C.

(57) ABSTRACT

A pixel includes a first transistor, a second transistor, a third transistor, and a capacitor. The first transistor connects a first power source to a light emitter based on a first control signal. The second transistor connects a pixel circuit to the light emitter. The third transistor connects a second power source to the pixel circuit based on a second control signal. The capacitor is a MOS capacitor having a first electrode connected to receive the second control signal and a second electrode connected to the second transistor.

19 Claims, 7 Drawing Sheets

PIXEL AND ORGANIC LIGHT EMITTING DISPLAY DEVICE USING THE SAME

CROSS-REFERENCE TO RELATED APPLICATION

Korean Patent Application No. 10-2015-0113903, filed on Aug. 12, 2015, and entitled, "Pixel and Organic Light Emitting Display Device Using the Same," is incorporated by reference herein in its entirety.

BACKGROUND

1. Field

One or more embodiments described herein relate to a pixel and an organic light emitting display device that includes one or more pixels.

2. Description of the Related Art

A variety of displays have been developed. Examples include liquid crystal displays and organic light emitting displays. An organic light emitting display may include a scan driver to drive scan lines and a data driver to drive data lines. The scan driver may supply scan signals to the scan lines to allow pixels to be selected on a horizontal line basis. The data driver may supply data signals in synchronization with the scan signals. The data signals may then be supplied to the selected pixels.

Each pixel generates light with predetermined brightness by controlling an amount of current that flows from a first power source to a second power source, via an organic light emitting diode (OLED). Emission times of the pixels are controlled by emission control signals supplied from emission control lines.

Advances in technology have allowed the efficiency of OLEDs to increase to the point where light emission may occur with low amounts of current. This has allowed images to be displayed with high brightness and low power consumption. However, OLEDs in these types of displays may emit light at undesired points in time. This may result in a reduction in contrast ratio.

SUMMARY

In accordance with one or more embodiments, a pixel includes an organic light emitting diode (OLED); a pixel circuit to control an amount of current to flow from a first power source to a second power source via the OLED; a first transistor connected between an initializing power source and an anode electrode of the OLED, a gate electrode of the first transistor connected to a control line; a second transistor connected between the pixel circuit and the anode electrode of the OLED; a third transistor connected between the first power source and the pixel circuit, a gate electrode of the third transistor connected to an emission control line; and a capacitor connected between the emission control line and the gate electrode of the second transistor.

The capacitor may include a transistor having a gate electrode connected to the emission control line and a first electrode and a second electrode connected to the gate electrode of the second transistor. The transistor of the capacitor may be an NMOS transistor and the first to third transistors are PMOS transistors.

The pixel circuit may include a fourth transistor having a first electrode connected to the third transistor, a second electrode connected to the second transistor, and a gate electrode connected to a first node; a fifth transistor connected between the first node and the second electrode of the fourth transistor, the fifth transistor having a gate electrode connected to a current scan line; a sixth transistor connected between the first node and the initializing power source, the sixth transistor having a gate electrode connected to a previous scan line; a seventh transistor connected between a data line and the first electrode of the fourth transistor, the seventh transistor having a gate electrode connected to the current scan line; and a storage capacitor connected between the first power source and first node. The current scan line may be an ith scan line and the previous scan line may be an (i−1)th scan line. The initializing power source may have a voltage lower than a data signal that is to be supplied to the data line.

In accordance with one or more other embodiments, an organic light emitting display device includes a scan driver to supply scan signals to scan lines and emission control signals to emission control lines; a control driver to supply control signals to control lines; a data driver to supply data signals to data lines; and a plurality of pixels adjacent intersections of the scan and data lines, wherein a pixel in an ith line extending in a first direction includes: an organic light emitting diode (OLED); a pixel circuit to control an amount of current to flows from a first power source to a second power source via the OLED; a first transistor connected between an initializing power source and an anode electrode of the OLED, the first transistor having a gate electrode connected to an ith control line; a second transistor connected between the pixel circuit and the anode electrode of the OLED; a third transistor connected between the first power source and the pixel circuit, the third transistor having a gate electrode connected to an ith emission control line; and a capacitor connected between the ith emission control line and the gate electrode of the second transistor.

The capacitor may include a transistor having a gate electrode connected to the emission control line and a first electrode and a second electrode connected to the gate electrode of the second transistor. The transistor of the capacitor may be an NMOS transistor, and the first to third transistors may be PMOS transistors.

The control driver may supply at least one control signal to the ith control line to overlap an emission control signal to be supplied to the ith emission control line at least in a partial period. A control signal may be supplied to the ith control line immediately after the emission control signal is supplied to the ith emission control line. The control signal may be supplied to the ith control line before the emission control signal is supplied to the ith emission control line. The control signal may be supplied to the ith control line to overlap at least one scan signal supplied to the pixel circuit.

The pixel circuit may include a fourth transistor having a first electrode connected to the third transistor, a second electrode connected to the second transistor, and a gate electrode connected to a first node; a fifth transistor connected between the first node and the second electrode of the fourth transistor, the fifth transistor having a gate electrode connected to an ith scan line; a sixth transistor connected between the first node and the initializing power source, the sixth transistor having a gate electrode connected to an (i−1)th scan line; a seventh transistor connected between a data line and the first electrode of the fourth transistor, the seventh transistor having a gate electrode connected to the ith scan line; and a storage capacitor connected between the first power source and first node. The initializing power source may have a voltage lower than the data signal.

In accordance with one or more other embodiments, a pixel includes a first transistor to connect a first power source to a light emitter based on a first control signal; a second transistor to connect a pixel circuit to the light emitter; a third transistor to connect a second power source to the pixel circuit based on a second control signal; and a capacitor connected between a control line of the second control signal and the second transistor, the capacitor being a MOS capacitor with a first electrode connected to receive the second control signal and a second electrode connected to the second transistor.

The first electrode of the MOS capacitor may be a gate electrode of a transistor of a first conductivity type, and the second electrode of the MOS capacitor may correspond to source and drain electrodes of the transistor of the first conductivity type. The first, second, and third transistors may be transistors of a second conductivity type. The capacitor may transmit a voltage of the second control signal to a gate electrode of the second transistor. The pixel circuit maybe connected to receive a current scan signal and a previous scan signal.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
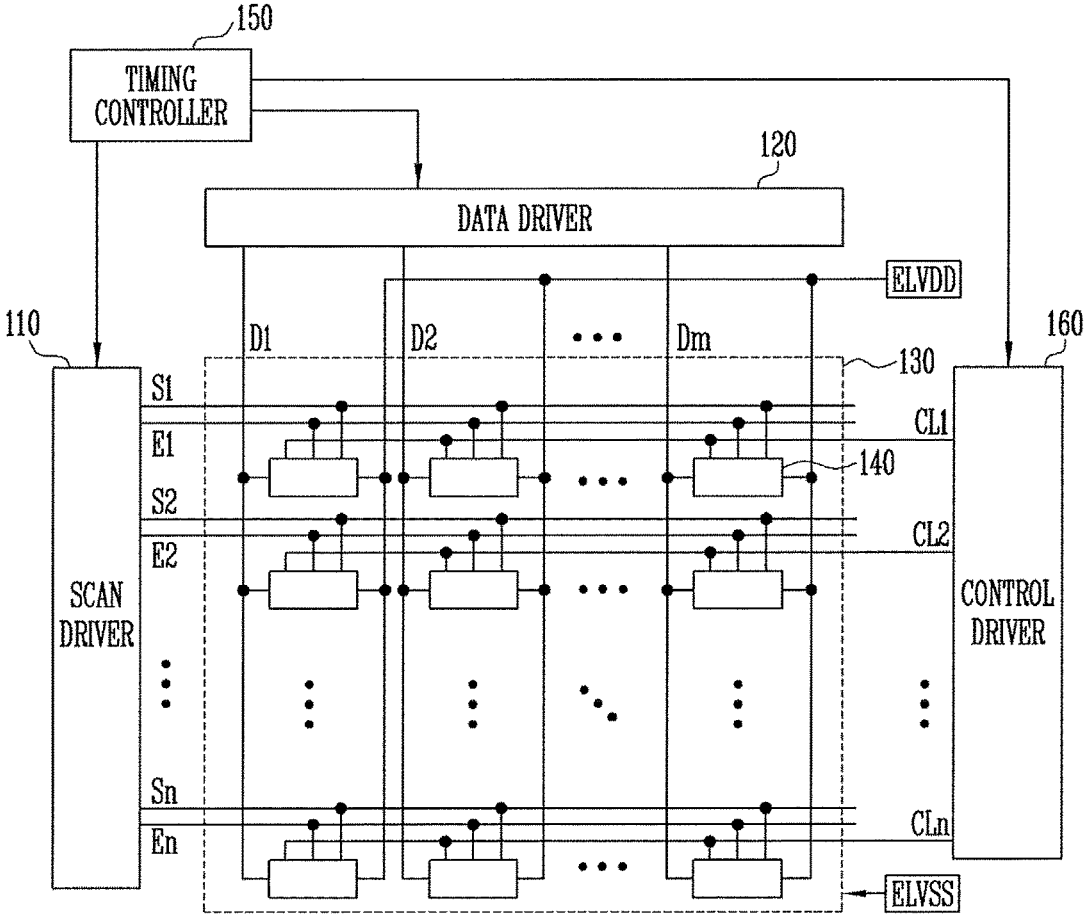
FIG. 1 illustrates an embodiment of an organic light emitting display device.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an organic light emitting display device which includes a pixel unit 130 having pixels 140 positioned in regions divided by scan lines S1 to Sn and data lines D1 to Dm, a scan driver 110 for driving the scan lines S1 to Sn and emission control lines E1 to En, a data driver 120 for driving the data lines D1 to Dm, a control driver 160 for driving control lines CL1 to CLn, and a timing controller 150 for controlling the scan driver 110, the data driver 120, and a control driver 160.

The scan driver 110 supplies scan signals to the scan lines S1 to Sn and supplies emission control signals to the emission control lines E1 to En by control of the timing controller 150. For example, the scan driver 110 sequentially supplies the scan signals to the scan lines S1 to Sn and may sequentially supply the emission control signals to the emission control lines E1 to En.

An emission control signal may be set, for example, to have a larger width than a scan signal. In one embodiment, an emission control signal may be supplied to overlap at least two scan signals. The emission control signals may be set to have gate-off voltages (e.g., high voltages) to turn off transistors in the pixels 140. The scan signals may be set to have gate-on voltages (e.g., low voltages) to turn on transistors in the pixels 140.

The data driver 120 supplies data signals to the data lines D1 to Dm in response to the control of the timing controller 150. The data signals are then supplied from the data lines D1 to Dm to the pixels 140 (e.g., in units of horizontal lines) selected by the scan signals.

The control driver 160 supplies control signals to the control lines CL1 to CLn in response to the control of the timing controller 150. For example, the control driver 160 may sequentially supply the control signals to the control lines CL1 to CLn. In addition, the control signals are set to have gate-on voltages to turn on the transistors in the pixels 140.

The pixel unit 130 includes the pixels 140 adjacent intersections of the scan lines S1 to Sn, the emission control lines E1 to En, and the control lines CL1 to CLn formed in a first (e.g., horizontal) direction, The data lines D1 to Dm may be formed in a second (e.g., vertical) direction. The pixels 140 store the data signals from the data lines D1 to Dm and are selected by the scan signals in units of horizontal lines. Then, each pixel 140 generates light with predetermined brightness based on a controlled amount of current flowing from a first power source ELVDD to a second power source ELVSS, via an organic light emitting diode (OLED), in response to a corresponding data signal.

The timing controller 150 controls the scan driver 110, the data driver 120, and the control driver 160 based on signals from, for example, from an external source.

In FIG. 1, each pixel 140 is connected to one scan line. In another embodiment, each pixel 140 may have a structure which allows it to be connected to a plurality of scan lines. In this case, for example, the pixel unit 130 may include dummy scan lines.

Figure 2:
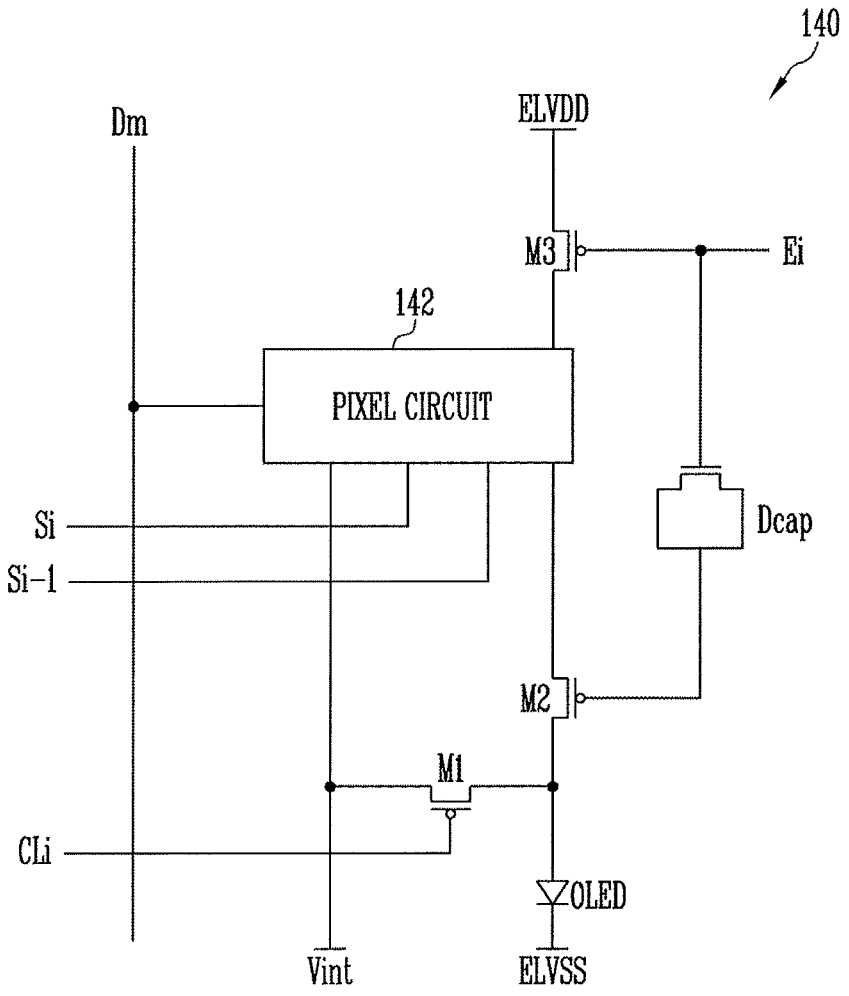
FIG. 2 illustrates an embodiment of a pixel.

FIG. 2 illustrates an embodiment of a pixel 140, which, for example, may be representative of the pixels in FIG. 1. In FIG. 2, the pixel 140 is connected to the mth data line Dm and an ith scan line S1 for illustrative purposes.

Referring to FIG. 2, the pixel 140 includes an organic light emitting diode OLED, a pixel circuit 142, first to third transistors M1 to M3, and a capacitor Dcap. The OLED has an anode electrode connected to the pixel circuit 142 via the second transistor M2 and a cathode electrode connected to the second power source ELVSS. The organic light emitting diode OLED generates light with predetermined brightness in response to an amount of a current supplied from the pixel circuit 142.

The pixel circuit 142 controls the amount of the current that flows from the first power source ELVDD to the second power source ELVSS, via the organic light emitting diode OLED, in response to a data signal. For example, the pixel circuit 142 initializes a gate electrode of a driving transistor when a scan signal is supplied to a (i−1)th scan line Si−1 and stores the data signal from the data line Dm when a scan signal is supplied to the ith scan line Si. The pixel circuit 142 controls the amount of the current supplied to the organic light emitting diode OLED in response to the data signal when supply of an emission control signal to an ith emission control line Ei is stopped.

The first power source ELVDD may be set to have a higher voltage than the second power source ELVSS to allow current to flow to the organic light emitting diode OLED.

The first transistor M1 is connected between an initializing power source Vint and the anode electrode of the organic light emitting diode OLED. A gate electrode of the first transistor M1 is connected to an ith control line CLi. The first transistor M1 is turned on, when a control signal is supplied to the ith control line CLi, in order to supply a voltage of the initializing power source Vint to the anode electrode of the organic light emitting diode OLED. The initializing power source Vint may have voltage lower than the data signal.

The first transistor M1 may improve black display capability of the pixel 140. For example, when the first transistor M1 is turned on, a parasitic capacitor of the organic light emitting diode OLED may be discharged. Then, when black brightness is to be implemented, due to a leakage current from the pixel circuit 142, the organic light emitting diode OLED does not emit light, thereby improving black display capability.

In addition, the control driver 160 may supply at least one control signal to the ith control line CLi, so that the control signal overlaps the emission control signal supplied to the ith emission control line Ei at least in a partial period.

The second transistor M2 is connected between the pixel circuit 142 and the anode electrode of the organic light emitting diode OLED. A gate electrode of the second transistor M2 is connected to the ith emission control line Ei via the capacitor Dcap. The second transistor M2 is turned off when the emission control signal is supplied to the ith emission control line Ei and is turned on in the other cases.

The third transistor M3 is connected between the first power source ELVDD and the pixel circuit 142. A gate electrode of the third transistor M3 is connected to the ith emission control line Ei. The third transistor M3 is turned off when the emission control signal is supplied to the ith emission control line Ei and is turned on in the other cases.

The capacitor Dcap is connected between the ith emission control line Ei and the gate electrode of the second transistor M2. The capacitor Dcap may be formed of a dynamic capacitor in order to be driven when the emission control signal is supplied to the ith emission control line Ei. The capacitor Dcap may be, for example, a MOS capacitor. In one embodiment, the capacitor Dcap is formed of an n-channel metal-oxide-semiconductor field-effect transistor (MOSFET) (NMOS) having a gate electrode connected to the ith emission control line Ei and first and second electrodes (e.g., source and drain electrodes) connected to the gate electrode of the second transistor M2.

In one embodiment, the capacitor Dcap is formed of an NMOS transistor and the first to third transistors M1 to M3 are p-channel metal-oxide-semiconductor field-effect transistors (MOSFET) (PMOS). The capacitor Dcap functions as a coupling capacitor to transmit a voltage of the emission control signal from the ith emission control line Ei to the gate electrode of the second transistor M2.

For example, since the third transistor M3 is positioned between the first power source ELVDD and the pixel circuit 142, the third transistor M3 may be completely turned off when the emission control signal is supplied to the ith emission control line Ei in order to normally drive the pixel circuit 142. Therefore, the emission control signal supplied to the ith emission control line Ei may be set to have a high voltage.

When the emission control signal is supplied to the ith emission control line Ei, the voltage of the anode electrode of the organic light emitting diode OLED may increase due to a parasitic capacitor of the second transistor M2. As a result, undesired light may be generated by the organic light emitting diode OLED, which, in turn, may reduce contrast ratio.

In order to reduce or minimize such a phenomenon, according to the present embodiment, the capacitor Dcap is formed between the ith emission control line Ei and the gate electrode of the second transistor M2. In this case, the voltage transmitted to the gate electrode of the second transistor M2 by the capacitor Dcap is set to be lower than the voltage (e.g., the voltage of the emission control signal) of the ith emission control line. It is therefore possible to reduce or minimize the amount of the light generated by the organic light emitting diode OLED and to increase contrast ratio.

Figure 3:
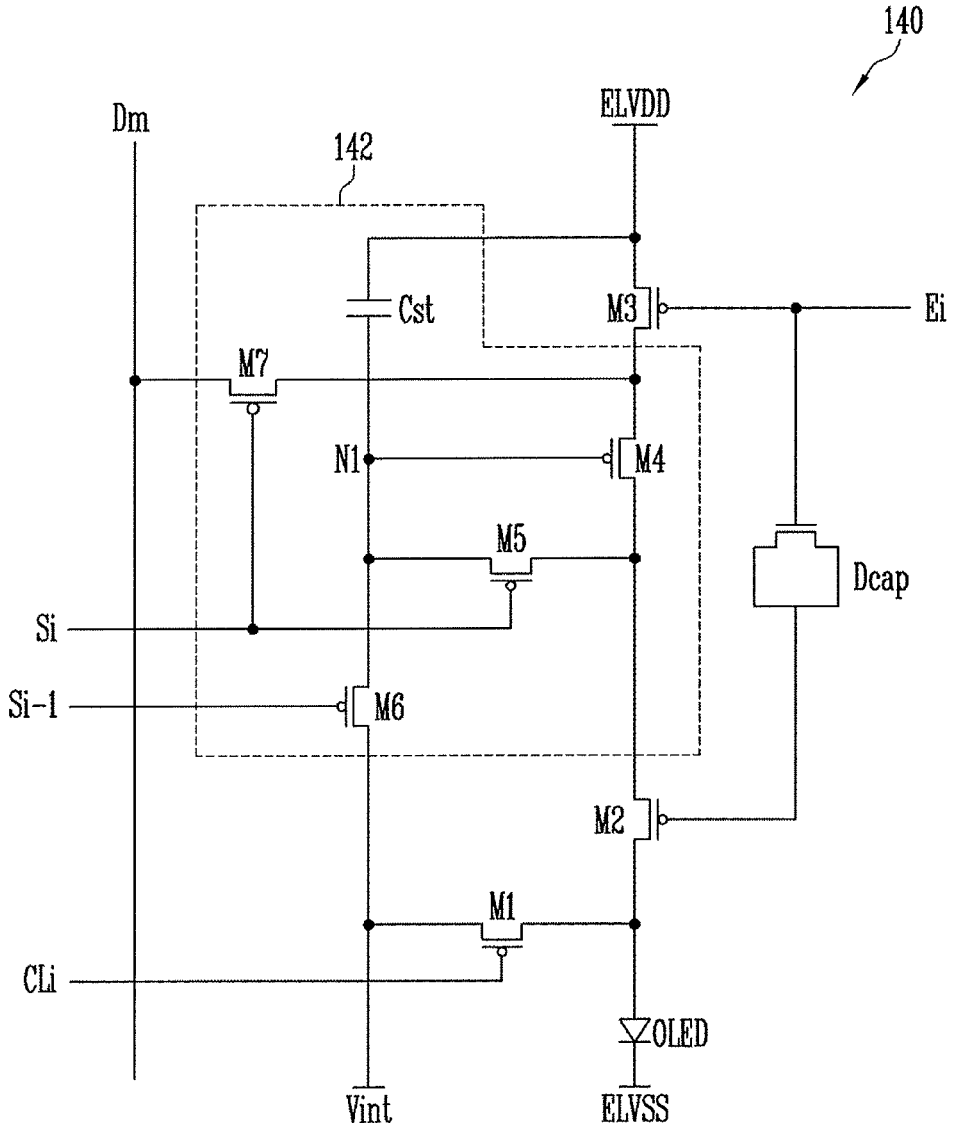
FIG. 3 illustrates an embodiment of a pixel circuit.

FIG. 3 illustrates an embodiment of the pixel circuit 142 in FIG. 2 which includes fourth to seventh transistors M4 to M7 and a storage capacitor Cst. The fourth transistor M4 (e.g., the driving transistor) has a first electrode connected to the first power source ELVDD via the third transistor M3 and a second electrode connected to the anode electrode of the organic light emitting diode OLED via the second transistor M2. The fourth transistor M4 has a gate electrode connected to a first node N1. The fourth transistor M4 controls the amount of current that flows from the first power source ELVDD to the second power source ELVSS, via the organic light emitting diode OLED, in response to a voltage of the first node N1.

The fifth transistor M5 is connected between the second electrode of the fourth transistor M4 and the first node N1. The fifth transistor M5 has a gate electrode connected to the ith scan line Si. The fifth transistor M5 is turned on when the scan signal is supplied to the ith scan line Si and electrically connects the second electrode of the fourth transistor M4 and the first node N1. Therefore, when the fifth transistor M5 is turned on, the fourth transistor M4 is diode-connected.

The sixth transistor M6 is connected between the first node N1 and the initializing power source Vint. The sixth transistor M6 has a gate electrode connected to the (i−1)th scan line Si−1. The sixth transistor M6 is turned on when the scan signal is supplied to the (i−1)th scan line Si−1 to supply the voltage of the initializing power source Vint to the first node N1.

A seventh transistor M7 is connected between the data line Dm and the first electrode of the fourth transistor M4. The seventh transistor M7 has a gate electrode connected to the ith scan line Si. The seventh transistor M7 is turned on when the scan signal is supplied to the ith scan line Si to electrically connect the data line Dm and the first electrode of the fourth transistor M4.

The storage capacitor Cst is connected between the first power source ELVDD and the first node N1. The storage capacitor Cst stores a voltage of the data signal and a threshold voltage of the fourth transistor M4.

Figure 4A:
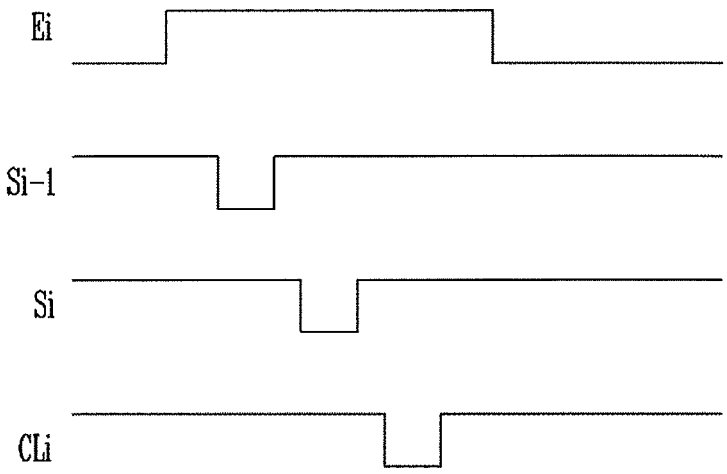
FIGS. 4A-4C illustrate embodiments of waveforms for driving a pixel.

FIG. 4A illustrates waveforms of a first embodiment of a method for driving a pixel, which, for example, may be pixel 140 in FIG. 3. Referring to FIG. 4A, first, the emission control signal is supplied to the ith emission control line Ei. When the emission control signal is supplied to the ith emission control line Ei, the second transistor M2 and the third transistor M3 are turned off.

At this time, the emission control signal is supplied to the gate electrode of the second transistor M2, via the capacitor Dcap, so that a voltage lower than that of the ith emission control line Ei is supplied to the gate electrode of the second transistor M2. Then, it is possible to reduce or minimize a rising voltage of the OLED generated by the parasitic capacitor of the second transistor M2 and thus to prevent the OLED from undesirably emitting light.

When the third transistor M3 is turned off, the first power source ELVDD and the first electrode of the fourth transistor M4 are electrically isolated from each other. When the second transistor M2 is turned off, the second electrode of the fourth transistor M4 and the anode electrode of the organic light emitting diode OLED are electrically isolated from each other. Therefore, in a period in which the emission control signal is supplied to the ith emission control line Ei, the pixel 140 is set to a non-emission state.

Then, the scan signal is supplied to the (i−1)th scan line Si−1. When the scan signal is supplied to the (i−1)th scan line Si−1, the sixth transistor M6 is turned on. When the sixth transistor M6 is turned on, the voltage of the initializing power source Vint is supplied to the first node N1.

After the scan signal is supplied to the (i−1)th scan line Si−1, the scan signal is supplied to the ith scan line Si. When the scan signal is supplied to the ith scan line Si, the fifth transistor M5 and the seventh transistor M7 are turned on.

When the fifth transistor M5 is turned on, the first node N1 and the second electrode of the fourth transistor M4 are electrically connected to each other. Thus, when the fifth transistor M5 is turned on, the fourth transistor M4 is diode-connected.

When the seventh transistor M7 is turned on, the data signal from the data line Dm is supplied to the first electrode of the fourth transistor M4. At this time, since the first node N1 is initialized to the voltage of the initializing power source Vint, the fourth transistor M4 is turned on. When the fourth transistor M4 is turned on, a voltage, obtained by subtracting the absolute value of a threshold voltage of the fourth transistor M4 from the voltage of the data signal, is supplied to the first node N1. At this time, the storage capacitor Cst stores the voltage of the data signal and the threshold voltage of the fourth transistor M4.

Then, the control signal is supplied to the ith control line CLi. When the control signal is supplied to the ith control line CLi, the first transistor M1 is turned on. When the first transistor M1 is turned on, the voltage of the initializing power source Vint is supplied to the anode electrode of the organic light emitting diode OLED in order to discharge the parasitic capacitor of the organic light emitting diode OLED.

After the control signal is supplied to the ith control line CLi, supply of the emission control signal to the ith emission control line Ei is stopped. When supply of the emission control signal to the ith emission control line Ei is stopped, the second transistor M2 and the third transistor M3 are turned on. When the third transistor M3 is turned on, the first power source ELVDD and the first electrode of the fourth transistor M4 are electrically connected to each other. When the second transistor M2 is turned on, the second electrode of the fourth transistor M4 and the anode electrode of the organic light emitting diode OLED are electrically connected to each other.

At this time, the fourth transistor M4 controls the amount of current that flows from the first power source ELVDD to the second power source ELVSS, via the organic light emitting diode OLED, in response to the voltage of the first node N1. Then, the organic light emitting diode OLED generates light with predetermined brightness in response to the amount of current supplied from the fourth transistor M4. In one embodiment, each of the pixels 140 may generate light with brightnesses that correspond to respective ones of the data signals by repeating the above-described processes.

The control signal is supplied to the ith control line CLi after the scan signal is supplied to the ith scan line Si in one or more of the above embodiments. In another embodiment, the control signal may be supplied to the ith control line CLi in various forms to at least partially overlap the emission control signal supplied to the ith emission control line Ei.

Figure 4B:
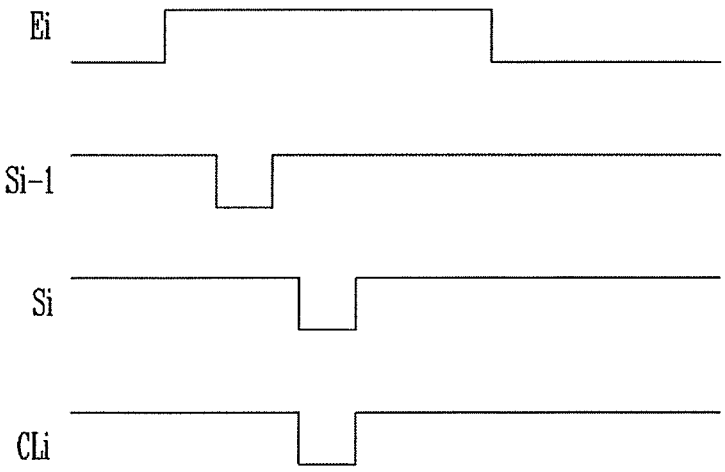
Figure 4C:
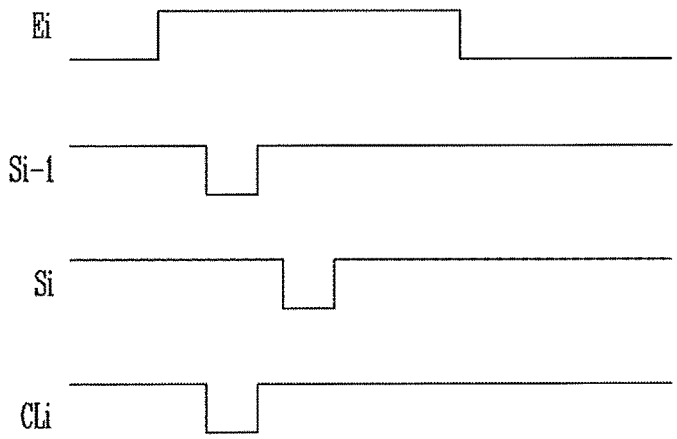

FIGS. 4B and 4C illustrate waveforms that correspond to another embodiment of a method for driving a pixel, e.g., the pixel 140 of FIG. 3. Referring to FIGS. 4B and 4C, the control signal is supplied to the ith control line CLi to overlap the scan signal supplied to the ith scan line Si or the scan signal supplied to the (i−1)th scan line Si−1. In this case, like in FIG. 4A, the anode electrode of the organic light emitting diode OLED may be initialized. In FIGS. 4B and 4C, operation processes may be the same as those in FIG. 4A, except for the point in time when the control signal supplied to the ith control line CLi changes.

Figure 5:
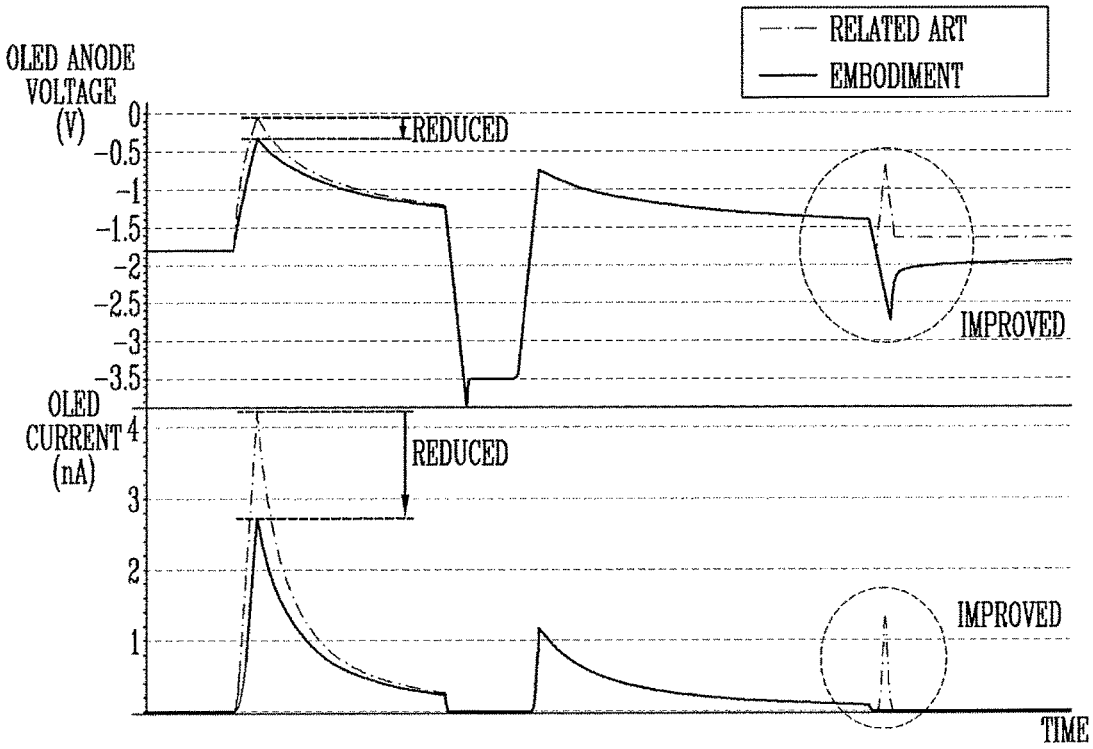
FIG. 5 illustrates example simulation results for the waveforms in FIG. 4A.

FIG. 5 illustrates an example of simulation results obtained by the embodiment of driving waveforms in FIG. 4A. In FIG. 5, the capacitor Dcap is added (e.g., to the embodiment of the pixel in FIG. 3) and a related art case is represented where capacitor Dcap is not included.

Referring to FIG. 5, when the emission control signal is supplied to the ith emission control line Ei, the voltage of the anode electrode of the organic light emitting diode OLED increases. At this time, due to influence of the capacitor Dcap, the rising voltage of the anode electrode of the organic light emitting diode OLED of the present embodiment is set to be lower than that in the related art.

In this case, the amount of current that flows to the organic light emitting diode OLED is reduced to thereby allow the emission brightness of the organic light emitting diode OLED to be reduced or minimized. Thus, according to the present embodiment, emission of light from the organic light emitting diode OLED may be suppressed using the capacitor Dcap. This may allow for an increase in contrast ratio. In addition, according to the present embodiment, the current of the organic light emitting diode OLED may maintain a stable state, even when supply of the emission control signal to the ith emission control line Ei is stopped.

Figure 6A:
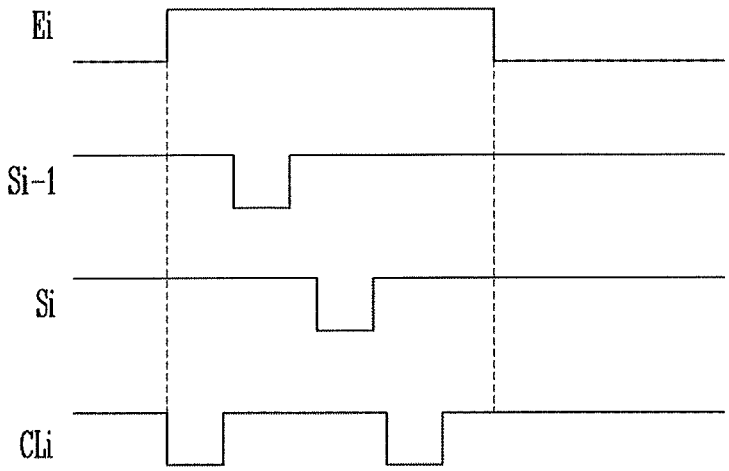
FIGS. 6A and 6B illustrate another embodiment for driving a pixel.
Figure 6B:
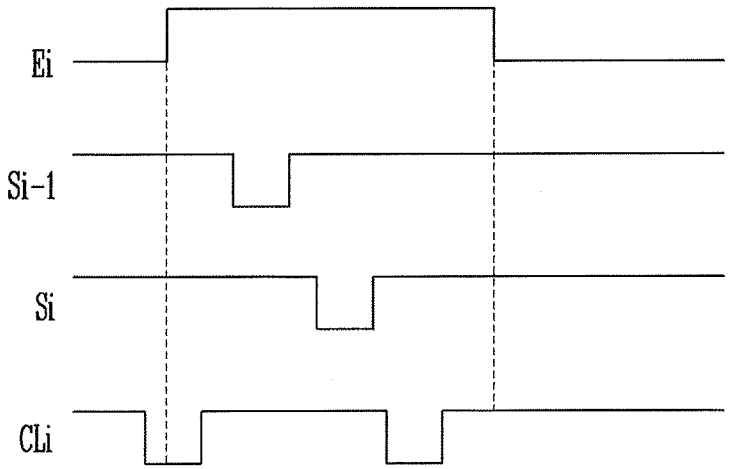

FIGS. 6A and 6B waveforms in accordance with another embodiment of a method for driving a pixel, e.g., pixel 140 in FIG. 3. Referring to FIGS. 6A and 6B, in this embodiment, a plurality of control signals are supplied to the ith control line CLi. For example, two control signals may be supplied to the ith control line CLi.

The control signals are supplied to the ith control line CLi to overlap the emission control signal supplied to the ith emission control line Ei at least in a partial period. For example, the first control signal may be supplied to the ith control line CLi before the scan signal is supplied to the (i−1)th scan line Si−1. The second control signal may be supplied to the ith control line CLi, after the first control signal, to overlap the emission control signal supplied to the ith emission control line Ei.

The first control signal supplied to the ith control line CLi may prevent the voltage of the anode electrode of the organic light emitting diode OLED from increasing due to the emission control signal supplied to the ith emission control line Ei.

For example, like in FIG. 6A, immediately after the emission control signal is supplied to the ith emission control line Ei, and when the first control signal is supplied to the ith control line CLi, the voltage of the anode electrode of the organic light emitting diode OLED may be initialized to the voltage of the initializing power source Vint. Thus, the voltage of the anode electrode of the organic light emitting diode OLED, that is increased by the emission control signal supplied to the ith emission control line Ei, is reduced to the voltage of the initializing power source Vint to thereby prevent the organic light emitting diode OLED from undesirably emitting light.

In addition, like in FIG. 6B, before the emission control signal is supplied to the ith emission control line Ei, the first control signal may be supplied to the ith control line CLi. Then, when the emission control signal is supplied to the ith emission control line Ei, the voltage of the initializing power source Vint is supplied to the anode electrode of the organic light emitting diode OLED to thereby prevent the organic light emitting diode OLED from undesirably emitting light.

Figure 7A:
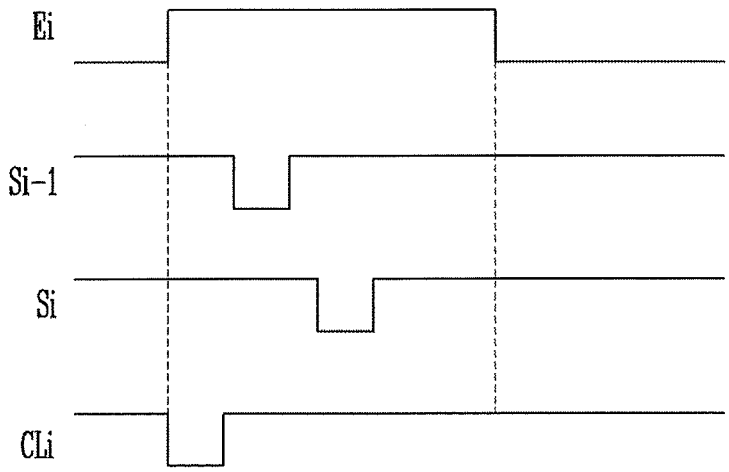
FIGS. 7A and 7B illustrate another embodiment for driving a pixel.
Figure 7B:
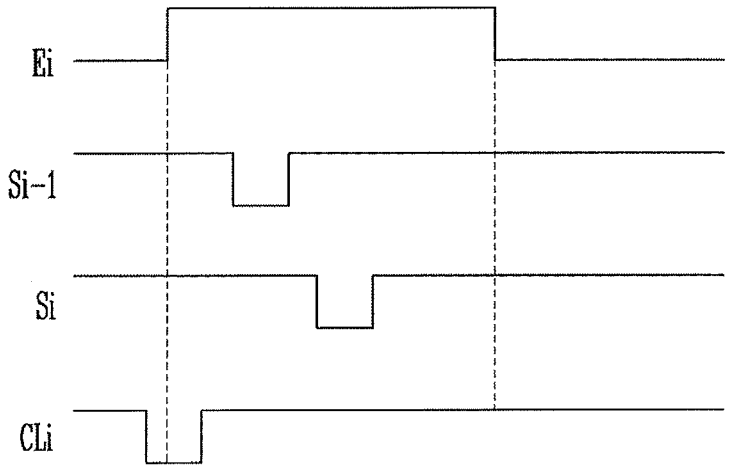

When the second control signal is supplied to the ith control line CLi, the voltage of the anode electrode of the organic light emitting diode OLED may be reset as the voltage of the initializing power source Vint. The second control signal may be supplied to the ith control line CLi for stable operation and may be removed as in FIGS. 7A and 7B.

In one embodiment, the organic light emitting diode OLED may generate one of various light components (e.g., red, green, and blue light components) in response to the amount of current supplied from the driving transistor. In another embodiment, the organic light emitting diode OLED may generate white light in response to the amount of current supplied from the driving transistor. In this case, a color image may be implemented using an additional color filter.

By way of summation and review, an OLED that is designed to emit light at low current may emit light at an undesired point in time. As a result, contrast ratio may be reduced. In accordance with one or more of the aforementioned embodiments, a pixel includes a first transistor, a second transistor, a third transistor, and a capacitor. The first transistor connects a first power source to a light emitter based on a first control signal. The second transistor connects a pixel circuit to the light emitter. The third transistor connects a second power source to the pixel circuit based on a second control signal. The capacitor is a MOS capacitor having a first electrode connected to receive the second control signal and a second electrode connected to the second transistor.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the embodiments in the following claims.

What is claimed is:

1. A pixel, comprising:

an organic light emitting diode (OLED);

a pixel circuit to control an amount of current to flow from a first power source to a second power source via the OLED;

a first transistor connected between an initializing power source and an anode electrode of the OLED, a gate electrode of the first transistor connected to a control line;

a second transistor connected between the pixel circuit and the anode electrode of the OLED;

a third transistor connected between the first power source and the pixel circuit, a gate electrode of the third transistor connected to an emission control line; and a capacitor connected between the emission control line and the gate electrode of the second transistor, wherein the pixel circuit includes:

a fourth transistor having a first electrode connected to the third transistor, a second electrode connected to the second transistor, and a gate electrode connected to a first node;

a fifth transistor connected between the first node and the second electrode of the fourth transistor, the fifth transistor having a gate electrode connected to a current scan line; and a sixth transistor connected between the first node and the initializing power source, the sixth transistor having a gate electrode connected to a previous scan line.

2. The pixel as claimed in claim 1, wherein the capacitor includes a transistor having a gate electrode connected to the emission control line and a first electrode and a second electrode connected to the gate electrode of the second transistor.

3. The pixel as claimed in claim 2, wherein the transistor of the capacitor is an NMOS transistor and the first to third transistors are PMOS transistors.

4. The pixel as claimed in claim 1, wherein the pixel circuit further includes:

a seventh transistor connected between a data line and the first electrode of the fourth transistor, the seventh transistor having a gate electrode connected to the current scan line; and a storage capacitor connected between the first power source and first node.

5. The pixel as claimed in claim 4, wherein:

the current scan line is an ith scan line, and the previous scan line is an (i−1)th scan line.

6. The pixel as claimed in claim 4, wherein the initializing power source has a voltage lower than a data signal that is to be supplied to the data line.

7. An organic light emitting display device, comprising:

a scan driver to supply scan signals to scan lines and emission control signals to emission control lines;

a control driver to supply control signals to control lines;

a data driver to supply data signals to data lines; and a plurality of pixels adjacent intersections of the scan and data lines, wherein a pixel in an ith line extending in a first direction includes:

an organic light emitting diode (OLED);

a pixel circuit to control an amount of current to flows from a first power source to a second power source via the OLED;

a first transistor connected between an initializing power source and an anode electrode of the OLED, the first transistor having a gate electrode connected to an ith control line;

a second transistor connected between the pixel circuit and the anode electrode of the OLED;

a third transistor connected between the first power source and the pixel circuit, the third transistor having a gate electrode connected to an ith emission control line; and a capacitor connected between the ith emission control line and the gate electrode of the second transistor, wherein the pixel circuit includes:

a fourth transistor having a first electrode connected to the third transistor, a second electrode connected to the second transistor, and a gate electrode connected to a first node;

a fifth transistor connected between the first node and the second electrode of the fourth transistor, the fifth transistor having a gate electrode connected to an ith scan line; and a sixth transistor connected between the first node and the initializing power source, the sixth transistor having a gate electrode connected to an (i−1)th scan line.

8. The display device as claimed in claim 7, wherein the capacitor includes a transistor having a gate electrode connected to the ith emission control line and a first electrode and a second electrode connected to the gate electrode of the second transistor.

9. The display device as claimed in claim 8, wherein: the transistor of the capacitor is an NMOS transistor, and the first to third transistors are PMOS transistors.

10. The display device as claimed in claim 7, wherein the control driver is to supply at least one control signal to the ith control line to overlap an emission control signal to be supplied to the ith emission control line at least in a partial period.

11. The display device as claimed in claim 10, wherein a control signal is to be supplied to the ith control line immediately after the emission control signal is supplied to the ith emission control line.

12. The display device as claimed in claim 10, wherein the control signal is to be supplied to the ith control line before the emission control signal is supplied to the ith emission control line.

13. The display device as claimed in claim 10, wherein the control signal is to be supplied to the ith control line to overlap at least one scan signal supplied to the pixel circuit.

14. The organic light emitting display device as claimed in claim 7, wherein the pixel circuit further includes:

a seventh transistor connected between a data line and the first electrode of the fourth transistor, the seventh transistor having a gate electrode connected to the ith scan line; and a storage capacitor connected between the first power source and first node.

15. The display device as claimed in claim 7, wherein the initializing power source has a voltage lower than the data signals.

16. A pixel, comprising:

a first transistor to connect a first power source to a light emitter based on a first control signal; a second transistor to connect a pixel circuit to the light emitter; a third transistor to connect a second power source to the pixel circuit based on a second control signal; and a capacitor connected between a control line of the second control signal and the second transistor, wherein the capacitor is a MOS capacitor having a first electrode connected to receive the second control signal and a second electrode connected to the second transistor, wherein the pixel circuit includes:

a fourth transistor having a first electrode connected to the third transistor, a second electrode connected to the second transistor, and a gate electrode connected to a first node; a fifth transistor connected between the first node and the second electrode of the fourth transistor, the fifth transistor having a gate electrode connected to a current scan line; and a sixth transistor connected between the first node and the initializing power source, the sixth transistor having a gate electrode connected to a previous scan line, wherein the pixel circuit is connected to receive a current scan signal and a previous scan signal.

17. The pixel as claimed in claim 16, wherein:

the first electrode of the MOS capacitor is a gate electrode of a transistor of a first conductivity type, and the second electrode of the MOS capacitor correspond to source and drain electrodes of the transistor of the first conductivity type.

18. The pixel as claimed in claim 17, wherein the first, second, and third transistors are transistors of a second conductivity type.

19. The pixel as claimed in claim 16, wherein the capacitor is to transmit a voltage of the second control signal to a gate electrode of the second transistor.

* * * * *